US009869107B2

(12) United States Patent
Moberg et al.

(10) Patent No.: US 9,869,107 B2
(45) Date of Patent: Jan. 16, 2018

(54) POLE ARRANGEMENT

(71) Applicant: Northcone AB, Borlänge (SE)

(72) Inventors: Fredrik Moberg, Saltsjö-Boo (SE); Peter Larsson, Tungelsta (SE); Lars Johansson, Saltsjö-Boo (SE)

(73) Assignee: Northcone AB, Borlänge (SE)

( * ) Notice: Subject to any disclaimer, the term of this patent is extended or adjusted under 35 U.S.C. 154(b) by 0 days.

(21) Appl. No.: 15/317,783

(22) PCT Filed: Jun. 3, 2015

(86) PCT No.: PCT/SE2015/050647
§ 371 (c)(1),
(2) Date: Dec. 9, 2016

(87) PCT Pub. No.: WO2015/190981
PCT Pub. Date: Dec. 17, 2015

(65) Prior Publication Data

US 2017/0121997 A1 May 4, 2017

(51) Int. Cl.
*E04H 12/22* (2006.01)
*E02D 27/42* (2006.01)
(Continued)

(52) U.S. Cl.
CPC ..... *E04H 12/2269* (2013.01); *E01F 9/631* (2016.02); *E01F 9/685* (2016.02); *E02D 27/42* (2013.01)

(58) Field of Classification Search
CPC . E01F 9/631; E01F 9/635; E01F 9/638; E01F 9/644; E01F 9/646; E01F 9/65;
(Continued)

(56) References Cited

U.S. PATENT DOCUMENTS 839,829 A * 1/1907 Fell ..... E04H 12/2276 52/297
5,060,437 A 10/1991 Parsons et al.
(Continued)

FOREIGN PATENT DOCUMENTS

| | | | |
|---|---|---|---|
| DE | 8802027 | U | 4/1988 |
| WO | 2005/064084 | A1 | 7/2005 |
| WO | 2010/136833 | A1 | 12/2010 |

*Primary Examiner* — Jessica Laux
(74) *Attorney, Agent, or Firm* — Dilworth & Barrese, LLP

(57) ABSTRACT

A pole arrangement comprising: —a pole (2) with a tubular external wall (4) of sheet metal; —a foundation (5) with a cavity (7) for receiving a lower section (8) of the external wall (4) of the pole; —a wedge element (6) for securing the pole in the cavity by wedging; and —a reinforcement element (23) mounted to a part of the section (8) of the external wall (4) of the pole received in the cavity, in order to counteract buckling of this part. The wedge element bears against the external wall of the pole through supporting projections, wherein there are free spaces between the supporting projections in order to allow parts of the external wall of the pole to be pressed into some of these spaces when the external is buckled in connection with a collision. The reinforcement element (23) is arranged at an axial distance from an upper opening (9) of the cavity in order to allow, in connection with a collision against the pole, buckling of the part of the external wall of the pole located between the reinforcement element and the opening of the cavity.

18 Claims, 5 Drawing Sheets

(51) Int. Cl.
*E01F 9/631* (2016.01)
*E01F 9/685* (2016.01)

(58) Field of Classification Search
CPC ... E01F 9/60; E01F 9/602; E01F 9/623; E01F 9/627; E01F 9/685; E04H 12/00; E04H 12/02; E04H 12/08; E04H 12/085; E04H 12/12; E04H 12/14; E04H 12/18; E04H 12/22; E04H 12/2253; E04H 12/2269; E04H 12/2276; E04H 12/2284; E04H 12/2292; E02D 27/42
See application file for complete search history.

(56) References Cited

U.S. PATENT DOCUMENTS

| | | | | |
|---|---|---|---|---|
| 2003/0121223 | A1* | 7/2003 | Riker | E04H 12/2269 52/296 |
| 2005/0196235 | A1 | 9/2005 | Strick | |
| 2008/0216443 | A1* | 9/2008 | Froese | E04H 12/2253 52/741.15 |
| 2009/0025332 | A1* | 1/2009 | Richards | E04H 12/2269 52/704 |
| 2009/0273261 | A1* | 11/2009 | Fournier | H02G 3/081 312/237 |
| 2010/0107521 | A1* | 5/2010 | Hotchkin | E01F 9/635 52/169.9 |
| 2013/0008096 | A1 | 1/2013 | Griffiths et al. | |

* cited by examiner

POLE ARRANGEMENT

FIELD OF THE INVENTION AND PRIOR ART

The present invention relates to a pole arrangement according to the discription herein.

A lighting pole or other type of road pole installed next to a road is usually designed to be yielding in connection with a collision so that the pole may absorb the horizontally directed forces from a colliding motor vehicle by being deformed in a suitable manner. During its deformation, the yielding pole is intended to absorb the kinetic energy of the colliding motor vehicle so that the motor vehicle is slowed down in a comparatively gentle manner instead of being subjected to a sudden halt, whereby the risk of series personal injuries for the people travelling in the motor vehicle is reduced.

Yielding road poles are previously known in many different designs. Different types of previously known yielding road poles are for instance shown in U.S. Pat. No. 5,060,437 A and US 2010/0107521 A1.

OBJECT OF THE INVENTION

The object of the present invention is to achieve a pole arrangement of the type mentioned by way of introduction with a new and favourable design.

SUMMARY OF THE INVENTION

According to the present invention, said object is achieved by a pole arrangement having the features hererin.

The pole arrangement according to the invention comprises:

- a hollow yielding pole having a tubular external wall of sheet metal;
- a foundation for anchoring the pole to the ground, this foundation having a vertical cavity for receiving a lower section of the tubular external wall with the tubular external wall extending through an opening at an upper end of the cavity; and
- a ring-shaped wedge element extending around the tubular external wall, this wedge element being arranged at the upper end of the cavity and clamped between the tubular external wall and an inner wall of the cavity in order to secure the pole in the cavity by wedging; and
- a reinforcement element which is mounted to a part of the section of the tubular external wall received in the cavity in order to counteract buckling of this part, wherein an upper end of the reinforcement element is arranged at a distance from said opening of the cavity as seen in the axial direction in order to allow, in connection with a collision against the pole, buckling of the part of the tubular external wall located between the upper end of the reinforcement element and the opening of the cavity. The wedge element is provided with supporting projections on its inner side, through which supporting projections the wedge element bears against the tubular external wall, wherein these supporting projections are arranged at a distance from each other as seen in the circumferential direction of the wedge element and wherein there are intermediate free spaces between the supporting projections as seen in the circumferential direction of the wedge element in order to allow parts of the tubular external wall to be pressed into some of these free spaces when the tubular external wall is subjected to buckling in connection with a collision against the pole.

When the above-mentioned pole is hit by a colliding motor vehicle, the tubular external wall will be buckled above the reinforcement element by the force from the motor vehicle, and parts of the tubular external wall will be pressed into some of the free spaces between the supporting projections of the wedge element. The design of the wedge element with supporting projections and intermediate free spaces on the side of the wedge element facing the tubular external wall of the pole will facilitate buckling of the part of the tubular wall located between the reinforcement element and the area hit by the motor vehicle. Thus, also the upper part of the section of the tubular external wall received in the cavity of the foundation will be buckled, which results in that the tubular external wall will be flattened and bend forwards in the direction of travel of the motor vehicle at the edge of the opening of the cavity. This deformation of the tubular external wall will contribute to a relatively gentle slowing down of the motor vehicle. The kinetic energy of the motor vehicle will also generate an axial pulling force on the section of the tubular external wall received in the cavity of the foundation, so that this section is displaced upwards in the cavity together with the reinforcement element. By its engagement with the tubular external wall, the wedge element will come loose from the cavity in connection with the upwardly directed displacement of said section of the tubular external wall, which will facilitate the further buckling of the tubular external wall. During said upwardly directed displacement, the reinforcement element will be slanted in the cavity of the foundation and cause a so-called drawer effect which slows down the displacement and prevents the pole from being torn loose from the foundation. Owing to the fact that the lower end of the pole is retained in the foundation, the pole may continue to contribute to an efficient slowing down of the motor vehicle during the entire deformation process. The wedge element and the reinforcement element will consequently co-operate in creating good opportunities for a relatively gentle but efficient slowing down of a motor vehicle in connection with a collision against the pole.

According to an embodiment of the invention, the reinforcement element has an axial length which is larger than or equal to 75% of the axial length of the section of the tubular external wall received in the cavity. With a length of the reinforcement element within this interval, a sufficiently efficient drawer effect is ensured at the same time as a bucklable area of sufficient length is left on the section of the tubular external wall received in the cavity of the foundation.

According to another embodiment of the invention, the reinforcement element is tubular. The reinforcement element can hereby be produced in a simple and efficient manner at the same time as the strength of the reinforcement element easily can be adapted by choosing a suitable material and wall thickness for the reinforcement element. Furthermore, it is relatively easy to mount a tubular reinforcement element to the tubular external wall of the pole.

According to an embodiment of the invention, the pole rests against a rest surface in the cavity through a lower end of the tubular external wall or a lower end of the reinforcement element.

According to another embodiment of the invention, the above-mentioned rest surface in the cavity of the foundation is conically tapered in the direction downwards. Hereby, it may in a simple manner be ensured that the pole is correctly mounted in the foundation with the lower end of the pole centered in the cavity of the foundation at the same time as it is ensured that the lower end of the tubular external wall or the lower end of the reinforcement element, already at the start of a deformation process, is in contact with and will slide upwards along an inner surface in the cavity under the influence of decelerating frictional forces.

According to another embodiment of the invention, a lower part of the reinforcement element projects below the lower end of the tubular external wall. It can hereby be ensured that the lower end of the pole during the deformation process will slide against the inner wall of the cavity of the foundation through the lower end of the reinforcement element instead of the lower end of the tubular external wall, whereby a big deformation of the lowest part of the tubular external wall, which in the worst case could result in a lost engagement between the tubular external wall and the reinforcement element, is avoided.

According to another embodiment of the invention, the tubular external wall has a polygonal cross-sectional shape with five or more sides, wherein at least three corners of the tubular external wall bear against a respective supporting projection of the wedge element and each one of the other corners of the tubular external wall extends through an intermediate free space between two supporting projections. The corners of the tubular external which do not bear against any supporting projection and instead extends through the intermediate free spaces between the supporting projections will form fold indications which facilitates for parts of the tubular external wall to be pressed into some of the free spaces between the supporting projections of the wedge element when the pole is hit by a motor vehicle, which contributes in facilitating the initial deformation of the tubular external wall in connection with a collision.

According to another embodiment of the invention, longitudinal slits are arranged in parallel with each other in the tubular external wall and distributed in the circumferential direction thereof in order to facilitate buckling of the tubular external wall in connection with a collision against the pole, wherein these slits are arranged in an area of the tubular external wall located above the foundation and where a colliding motor vehicle is expected to hit the tubular external wall. The buckling of the tubular external wall promoted by the slits at the area where the motor vehicle hits the pole will result in flattening and bending of the tubular external wall in this area. This deformation of the tubular external wall will contribute to a relatively gentle slowing down of the motor vehicle.

Other favourable features of the pole arrangement according to the invention will appear from the discription following below.

BRIEF DESCRIPTION OF THE DRAWINGS

The invention will in the following be more closely described by means of embodiment examples, with reference to the appended drawings. It is shown in.

DETAILED DESCRIPTION OF EMBODIMENTS OF THE INVENTION

Figure 1:
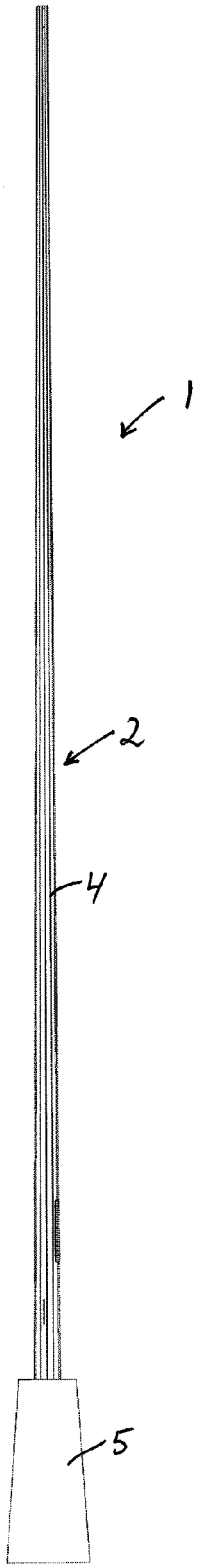
FIG. 1 a lateral view of a pole arrangement according to an embodiment of the present invention, FIG. 2 a perspective view of a part of the pole arrangement of FIG. 1, FIG. 3 an exploded view of parts included in the pole arrangement of FIG. 1, FIG. 4 a schematic longitudinal section through a part of the pole arrangement of FIG. 1, FIG. 5 a perspective view of a wedge element included in the pole arrangement of FIG. 1, FIG. 6 a planar view of the wedge element of FIG. 5 mounted to an associated pole, FIG. 7 a planar view of the wedge element of FIG. 5, with the pole shown in a buckled condition, and FIGS. 8*a*-8*d* schematic longitudinal sections through a part of the pole arrangement of FIG. 1, illustrating different stages during a deformation process under the effect of the force from a colliding motor vehicle.
Figure 2:
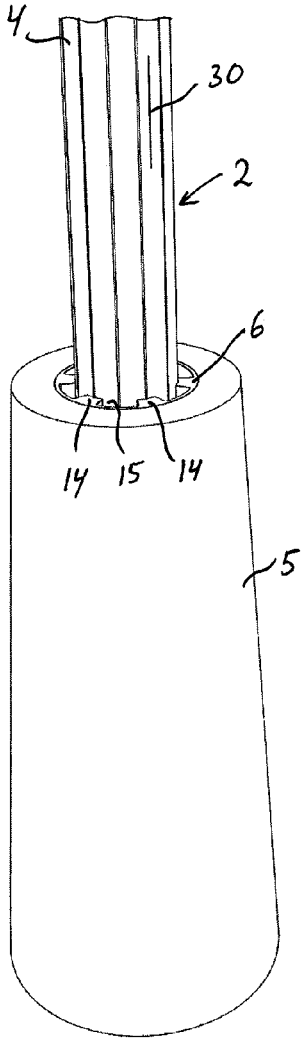
Figure 3:
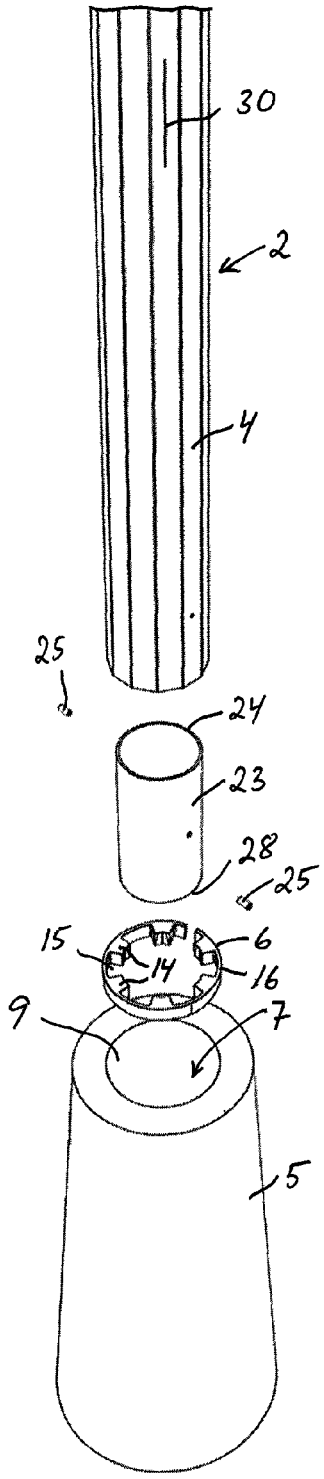
Figure 4:
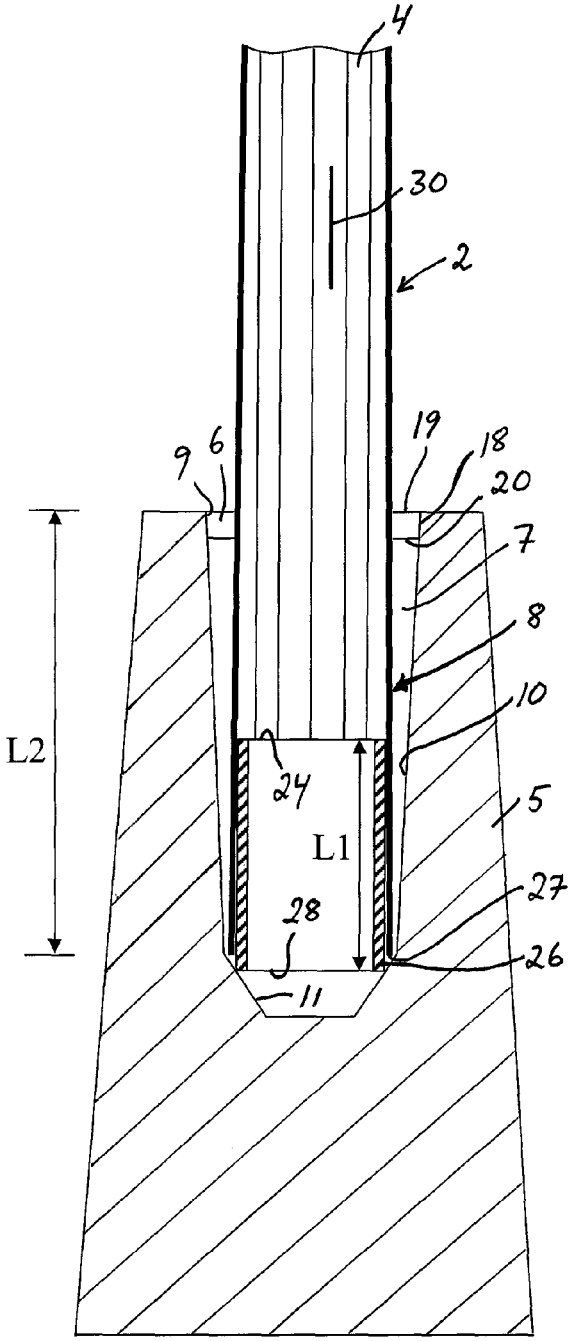
Figure 5:
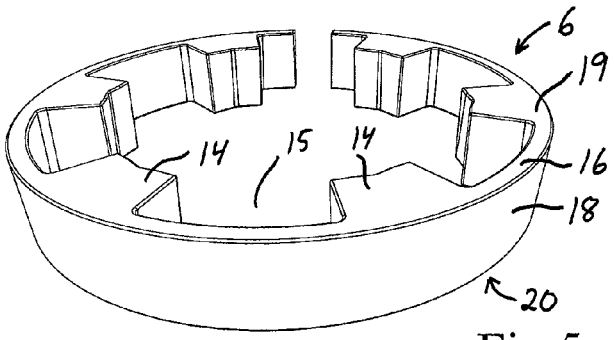

A pole arrangement 1 according to an embodiment of the present invention is illustrated in FIGS. 1-4. The pole arrangement 1 comprises a hollow elongated pole 2, which is intended to be installed next to a road. In the illustrated example, the pole 2 is a lighting pole intended to carry a light fitting. However, the pole arrangement 1 according to the invention could also comprise another type of pole, such as for instance a pole designed to carry a road sign. The pole 2 is designed to be yielding in connection with collision, i.e. so designed that it is deformed to a considerable extent by the force from a car or other motor vehicle colliding with the pole, even if the motor vehicle is running at a relatively low speed. The pole 2 has a tubular external wall 4 of sheet metal, for instance of high-strength steel with a thickness of about 2 mm. The tubular external wall 4 preferably has a polygonal cross-sectional shape with five or more sides and may for instance be manufactured by roll-forming a flat blank of sheet metal with conical shape. In the illustrated example, the tubular external wall 4 is twelve-sided and conically tapered in the direction upwards. However, the tubular external wall of the pole could as an alternative have a circular cross-sectional shape.

The pole arrangement 1 further comprises a foundation 5 for anchoring the pole 2 to the ground, and a ring-shaped wedge element 6 for securing the pole in the foundation.

The foundation 5 is preferably made of concrete and has a vertical cavity 7 for receiving a lower section 8 of the tubular external wall 4 with the tubular external wall extending through an opening 9 at an upper end of the cavity 7. In the illustrated example, the cavity has an inner wall 10 with circular cross-sectional shape which is conically tapered in the direction downwards. At its lower end, the inner wall 10 is connected to a rest surface 11, which is conically tapered in the direction downwards and which has a bigger inclination than the inner wall 10. The foundation 5 is intended to be buried in the ground with the opening 9 of the cavity on a level with the ground surface.

Figure 7:
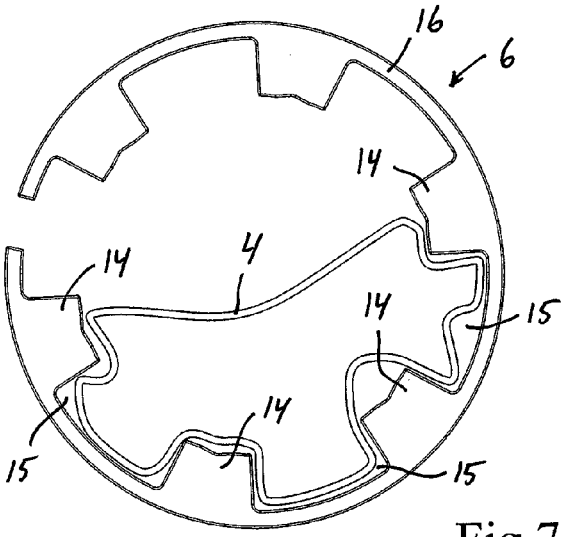

The wedge element 6 extends around the tubular external wall 4 and is arranged at the upper end of the cavity 7 of the foundation at the opening 9 of the cavity. The wedge element 6 is clamped between the tubular external wall 4 and the inner wall 10 of the cavity 7 in order to secure the pole 2 in the cavity 7 by wedging. The wedge element 6 is on its inner side provided with supporting projections 14, through which the wedge element 6 bears against the tubular external wall 4. The supporting projections 14 are suitably three or more in number. The supporting projections 14 are arranged at a distance from each other as seen in the circumferential direction of the wedge element, wherein there are intermediate free spaces 15 between the supporting projections 14 as seen in the circumferential direction of the wedge element in order to allow parts of the tubular external wall 4 to be pressed into some of these free spaces 15 when the tubular external wall is buckled as a motor vehicle collides with the pole 2, as illustrated in FIG. 7. In the illustrated example, the wedge element 6 comprises a base part 16 with the form of a broken ring, wherein the supporting projections 14 are connected to the base part 16 and extend from the base part in the radial direction inwards towards the centre axis 17 of the base part. The base part 16 has an envelope surface 18 which is conically tapered as seen in the axial direction from an upper edge 19 of the base part to a lower edge 20 of the base part, wherein the wedge element 6 bears against the inner wall 10 of the cavity through this envelope surface 18.

Figure 6:
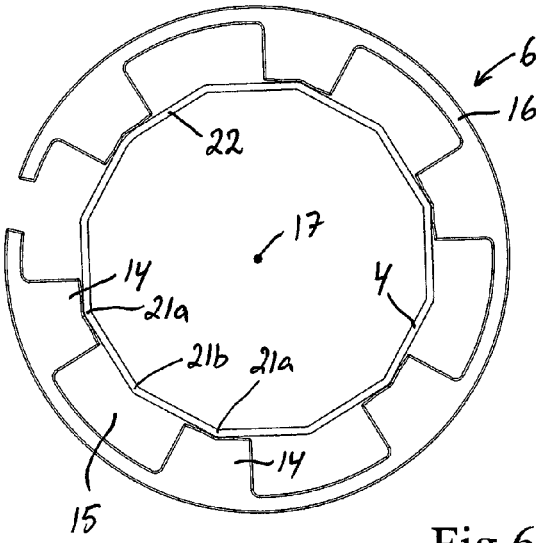

In the case when the tubular external wall 4 of the pole has a polygonal cross-sectional shape with an even number of sides 22, the wedge element 6 is suitably provided with half as many supporting projections 14 as the number of sides 22 of tubular external wall 4, wherein the wedge element 6 is mounted to the tubular external wall 4 in such a position that every second corner 21*a* of the tubular external wall 4 bears against a supporting projection 14 of the wedge element and each one of the other corners 21*b* of the tubular external wall 4 is arranged between two supporting projections 14, as illustrated in FIG. 6. Each one of the last-mentioned corners 21*b* of the tubular external wall 4 consequently extends through an intermediate free space 15 between two supporting projections 14. In the illustrated embodiment, the tubular external wall 4 is twelve-sided and the wedge element 6 is provided with six supporting projections 14 which are evenly distributed in the circumferential direction of the wedge element.

The wedge element 6 is suitably made of plastic.

A reinforcement element 23 is mounted to a part of the section 8 of the tubular external wall 4 received in the cavity 7, below the wedge element 6, in order to counteract that this part is buckled when a motor vehicle collides with the pole 2. In the illustrated embodiment, said part constitutes the lower part of the section 8 of the tubular external wall 4 received in the cavity 7. An upper end 24 of the reinforcement element 23 is arranged at a distance from the above-mentioned opening 9 of the cavity 7 as seen in the axial direction, in order to allow buckling of the part of the tubular external wall 4 located between the upper end 24 of the reinforcement element and the opening 9 of the cavity when a motor vehicle collides with the pole 2. In the illustrated embodiment, the upper end 24 of the reinforcement element 23 is furthermore arranged at a distance from a lower edge 20 of the wedge element 6 as seen in the axial direction. The reinforcement element 23 is suitably dimensioned to bear as close as possible against the tubular external wall 4 and is fixed to the tubular external wall by means of suitable fastening members 25 or in another suitable manner, for instance by welding. The reinforcement element 23 is suitably tubular and has with advantage a circular cross-sectional shape, but could however as an alternative have a polygonal cross-sectional shape, for instance in correspondence with the polygonal cross-sectional shape of the tubular external wall 4, or a star-shaped cross-sectional shape. The reinforcement element 23 is preferably mounted inside the tubular external wall 4, but could as an alternative be mounted on the outside thereof.

In the illustrated embodiment, the reinforcement element 23 is mounted to the tubular external wall 4 in such a manner that a lower part 26 of the reinforcement element 23 projects below the lower end 27 of the tubular external wall 4, to thereby allow the pole 2 to rest against the above-mentioned rest surface 11 in the cavity 7 through the lower end 28 of the reinforcement element. However, the pole 2 could as an alternative rest against the support surface 11 through the lower end 27 of the tubular external wall 4.

The axial length L1 of the reinforcement element 23 is to be larger than or equal to the diameter of the above-mentioned opening 9 of the cavity 7 and smaller than or equal to 75% of the axial length L2 of the section 8 of the tubular external wall 4 received in the cavity 7. The axial length L1 of the reinforcement element 23 is suitably 40-60%, preferably about 50%, of the axial length L2 of the section 8 of the tubular external wall 4 received in the cavity 7.

The reinforcement element 23 is suitably made of steel.

The tubular external wall 4 is with advantage provided with longitudinal slits 30, which are arranged in parallel with each other in the tubular external wall 4 and distributed in the circumferential direction thereof in order to facilitate buckling of the tubular external wall 4 when a motor vehicle collides with the pole 2. The slits 30 are arranged in an area of the tubular external wall 4 which is located above the foundation 5 and where a colliding motor vehicle is expected to hit the tubular external wall 4. The slits 30 are suitably three or more in number.

Figure 8B:
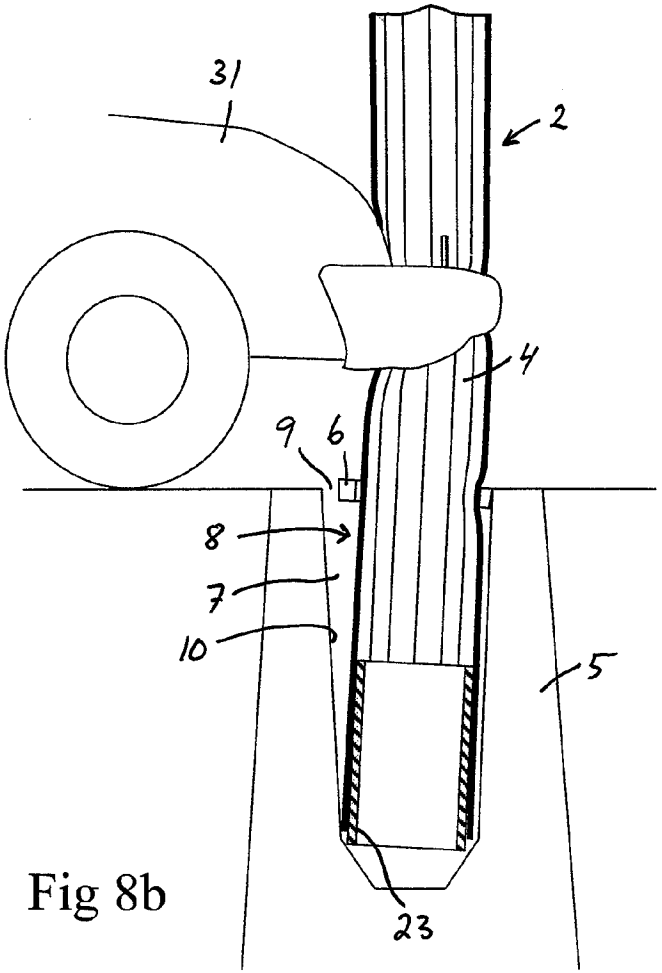
Figure 8A:
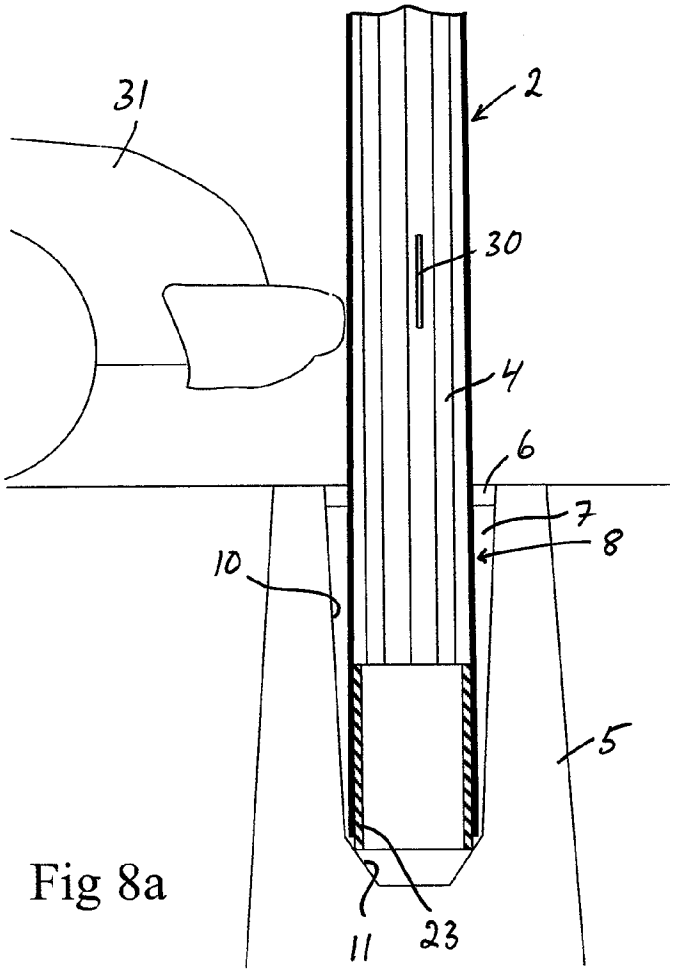
Figure 8D:
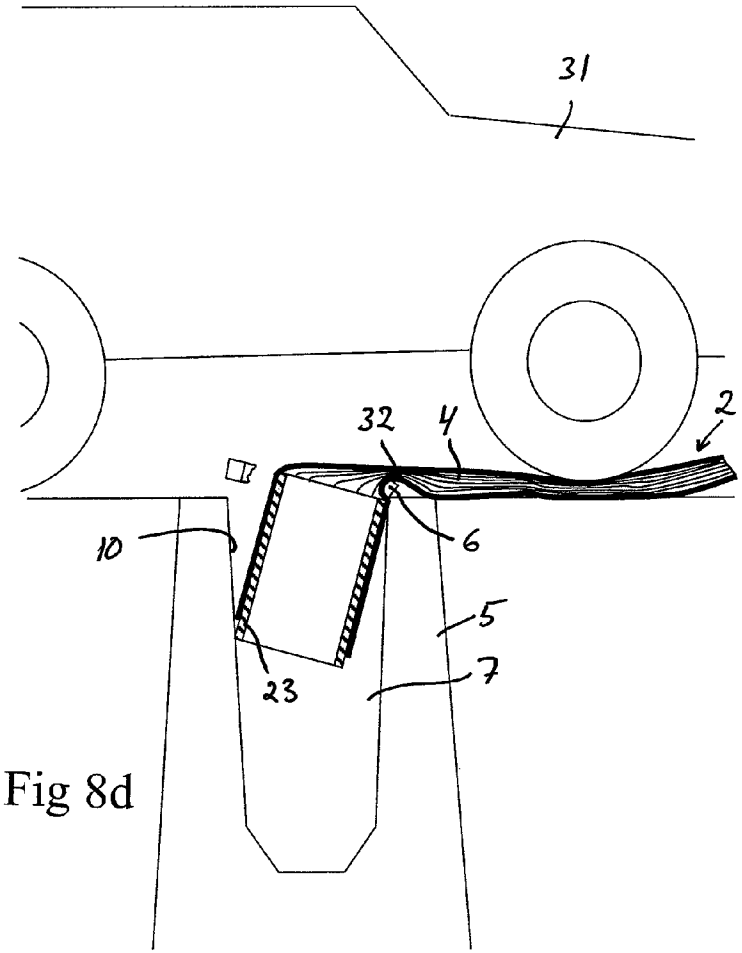
Figure 8C:
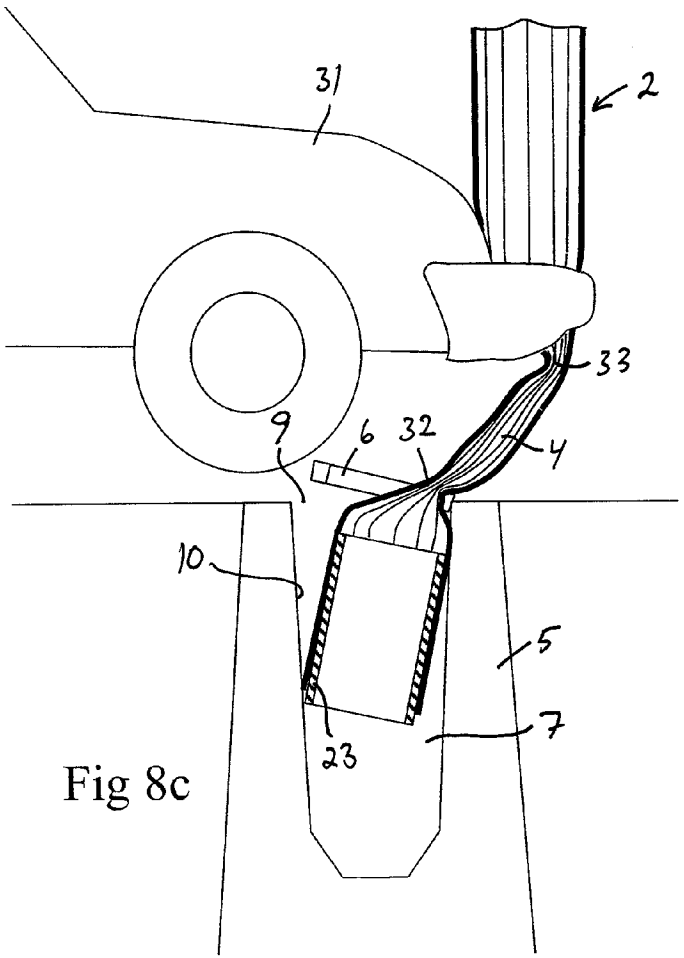

FIGS. 8*a*-8*d* very schematically show how the lower part of the pole 2 is deformed when a motor vehicle 31 in the form of a car collides with the pole. In a first stage of the collision process, the tubular external wall 4 is subjected to an initial buckling in the area where the motor vehicle 31 hits the tubular external wall 4, at the same time as the part of the tubular external wall 4 which bears against the wedge element 6 is pressed against one side of the wedge element and buckled, as illustrated in FIG. 8*b*. The kinetic energy of the motor vehicle 31 generates an axial pulling force on the section 8 of the tubular external wall 4 received in the cavity 7 of the foundation so that this section is displaced in the direction upwards together with the reinforcement element 23, at the same time as this section 8 and the reinforcement element 23 assume a slanted position in the cavity 7 and slide against the rest surface 11 and/or the inner wall 10 of the cavity. The frictional forces between the reinforcement element 23 or the tubular external wall 4 and the rest surface 11 or the inner wall 10 will slow down the upwardly directed displacement movement. Owing to the engagement between the wedge element 6 and the tubular external wall 4, a part of the wedge element will come along in the upwardly directed displacement movement and come off from its engagement with the inner wall 10 of the cavity, as illustrated in FIGS. 8*b* and 8*c*. During the continued buckling of the tubular external wall 4, this wall will be flattened in the area above the reinforcement element 23 under the formation of a first folding hinge 32 at the edge of the opening 9 of the cavity and a second folding hinge 33 just above the first folding hinge 32, as illustrated in FIG. 8*c*. The reinforcement element 23 will remain practically intact during the collision process, and by its engagement with the inner wall 10 of the cavity it prevents the pole 2 from being completely disengaged from the foundation 5. During its deformation, the tubular external wall 4 contributes in absorbing the kinetic energy of the motor vehicle 31 so that the motor vehicle is slowed down in a relatively gentle manner, whereby the risk of serious personal injuries for the people travelling in the motor vehicle is reduced. If the motor vehicle 31 is running at a high speed when colliding with the pole 2, the pole will fold down over the motor vehicle 31, and if the motor vehicle 31 is running at a low speed when colliding with the pole 2, the pole will fall forwards in the direction of travel of the motor vehicle.

The invention is of course not in any way limited to the embodiments described above. On the contrary, many possibilities to modifications thereof will be apparent to a person skilled in the art without thereby deviating from the basic idea of the invention as defined in the appended claims.

The invention claimed is:

1. A pole arrangement comprising:

a hollow yielding pole (2) having a tubular external wall (4) of sheet metal;

a foundation (5) for anchoring the pole (2) to the ground, this foundation (5) having a vertical cavity (7) for receiving a lower section (8) of the tubular external wall (4) with the tubular external wall extending through an opening (9) at an upper end of the cavity (7); and a ring-shaped wedge element (6) extending around the tubular external wall (4), this wedge element (6) being arranged at the upper end of the cavity (7) and clamped between the tubular external wall (4) and an inner wall (10) of the cavity (7) in order to secure the pole (2) in the cavity (7) by wedging, wherein the wedge element (6) on its inner side is provided with supporting projections (14), through which the wedge element (6) bears against the tubular external wall (4), these supporting projections (14) are arranged at a distance from each other as seen in the circumferential direction of the wedge element, there are intermediate free spaces (15) between the supporting projections (14) as seen in the circumferential direction of the wedge element to allow part of the tubular external wall (4) to be pressed into some of these free space3s (15) when the tubular external wall is subjected to buckling in connection with a collision against the pole;

a reinforcement element (23) is mounted to a part of the section (8) of the tubular external wall (4) received in the cavity (7) to counteract buckling of this part; and an upper end (24) of the reinforcement element (23) is arranged at a distance from said opening (9) of the cavity (7) as seen in the axial direction to allow, in connection with a collision against the pole (2), buckling of the part of the tubular external wall (4) located between the upper end (24) of the reinforcement element and the opening (9) of the cavity;

wherein the reinforcement element (23) is mounted inside the tubular external wall (4).

2. A pole arrangement according to claim 1, wherein the reinforcement element is mounted to the lower part of the section (8) of the tubular external wail (4) received in the cavity (7), to counteract buckling of this lower part.

3. A pole arrangement according to claim 1, wherein the upper end (24) of the reinforcement element (23) is arranged at a distance from a lower edge (20) of the wedge element (6) as seen in the axial direction, to allow, in connection with a collision against the pole (2), buckling of the part of the tubular external wall (4) located between the upper end (24) of the reinforcement element and the lower edge (20) of the wedge element.

4. A pole arrangement according to claim 1, wherein the reinforcement element (23) has an axial length (L1) which is larger than or equal to the diameter of said opening (9) of the cavity (7) and smaller than or equal to 75% of the axial length (L2) of the section (8) of the tubular external wall (4) received in the cavity (7).

5. A pole arrangement according to claim 1 wherein the reinforcement element (23) is tubular.

6. A pole arrangement according to claim 1, wherein the pole (2) rests against a rest surface (11) in the cavity (7) through a lower end (27) of the tubular external wall (4) or a lower end (28) of the reinforcement element (23).

7. A pole arrangement according to claim 6, wherein said rest surface (11) is conically tapered in the direction downwards.

8. A pole arrangement according to claim 1, wherein a lower part (26) of the reinforcement element (23) projects below the lower end (27) of the tubular external wall (4).

9. A pole arrangement according to claim wherein said supporting projections (14) of the wedge element (6) are at least three in number.

10. A pole arrangement according to claim 1, wherein the wedge element (6) comprises a base part (16) with the form of a broken ring, and the supporting projections (14) are connected to the base part (16) and extend from the base part in the radial direction inwards towards the centre axis (17) of the base part.

11. A pole arrangement according to claim 1, wherein the tubular external wall (4) is conically tapered in the direction upwards.

12. A pole arrangement according to claim 1, wherein the wedge element (6) has a radial gap extending through the outer circumference thereof.

13. A pole arrangement comprising:

a hollow yielding pole (2) having a tubular external wall (4) of sheet metal;

a foundation (5) for anchoring the pole (2) to the ground, this foundation (5) having a vertical cavity (7) for receiving a lower section (8) of the tubular external wall (4) with the tubular external wall extending through an opening (9) at an upper end of the cavity (7); and a ring-shaped wedge element (6) extending around the tubular external wall(4), this wedge element (6) being arranged at the upper end of the cavity (7) and clamped between the tubular external wall (4) and an inner wall (10) of the cavity(7) in order to secure the pole (2) in the cavity (7) by wedging, wherein the wedge element (6) on its inner side is provided with supporting projections (14), through which the wedge element (6) bears against the tubular external wall (4), these supporting projections (14) are arranged at a distance from each other as seen in the circumferential direction of the wedge element, there are intermediate free spaces (15) between the supporting projections (14) as been in the circumferential direction of the wedge element to allow parts of the tubular external wall (4) to be pressed into some of these free spaces (15) when the tubular external wall is subjected to buckling in connection with a collision against the pole, a reinforcement element (23) is mounted to a part of the section (8) of the tubular external wall (4) received in the cavity (7) to counteract buckling of this part, an upper end (24) of the reinforcement element (23) is arranged at a distance from said opening (9) of the cavity (7) as seen in the axial direction to allow, in connection with a collision against the pole (2), buckling of the part of the tubular external wall (4) located between the upper end (24) of the reinforcement element and the opening (9) of the cavity, the wedge element (6) comprises a base part (16) with the form of a broken ring, and the supporting proiections (14) are connected to the base part (16) and extend from the base part in the radial direction inwards towards the centre axis (17) of the base part, and said base part (16) has an envelope surface (18) which is conically tapered as seen in the axial direction from an upper edge (19) of the base part to a lower edge (20) of the base part, and the wedge element (6) bears against the inner wall (90) of the cavity through this envelope surface (18).

14. A pole arrangement comprising:

a hollow yielding pole (2) having a tubular external (4) of sheet metal;

a foundation (5) for anchoring the pole (2) to the ground, this foundation (5) having a vertical cavity (7) for receiving a lower section (8) of the tubular external wall (4) with the tubular external wall extending through an opening (9) at an upper end of the cavity (7); and a ring-shaped wedge element (6) extending around the tubular external wall (4), this wedge element (6) being arranged at the upper end of the cavity (7) and clamped between the tubular external wall (4) and an inner wall (10) of the cavity (7) in order to secure the pole (2) in the cavity (7) by wedging, wherein the wedge element (6) on its inner side is provided with supporting projections (14), through which the wedge element (6) bears against the tubular external wall (4), these supporting projections (14) are arranged at a distance from each other as seen in the circumferential direction of the wedge element, there are intermediate frees aces 15 between the supporting projections (14) as seen in the circumferential direction of the wedge element to allow parts of the tubular external wall (4) to be pressed into some of these free spaces (15) when the tubular external wall is subjected to buckling in connection with a collision against the pole, a reinforcement element (23) is mounted to a part of the section (8) of the tubular external wall (4) received in the cavity (7) to counteract buckling of this part, an upper end (24) of the reinforcement element (23) is arranged at a distance from said opening (9) of the cavity (7) as seen in the axial direction to allow, in connection with a collision against the pole (2), buckling of the part of the tubular external wall (4) located between the upper end (24) of the reinforcement element and the opening (9) of the cavity, the tubular external wall (4) has a polygonal cross-sectional shape with five or more sides (22), at least three corners (21*a*) of the tubular external wall (4) bear against a respective supporting projection (14) of the wedge element (6), and each one of the other corners (21*b*) of the tubular external wall (4) extends through an intermediate free space (15) between two supporting projections (14).

15. A pole arrangement according to claim 14, wherein the tubular external wall (4) has an even number of sides (22), every second corner (21*a*) of the tubular external wall (4) bears against a supporting projection (14) of the wedge element (6), and each one of the other corners (21*b*) of the tubular external wall (4) extends through an intermediate free space (15) between two supporting projections (14). of the tubular external wall (4) extends through an intermediate free space (15) between two supporting projections (14).

16. A pole arrangement comprising:

a hollow yielding pole (2) having a tubular external wall (4) of sheet metal;

a foundation (5) for anchoring the pole (2) to the ground, this foundation (5) having a vertical cavity (7) for receiving a lower section (8) of the tubular external wall (4) with the tubular external wall extending through an opening (9) at an upper end of the cavity (7); and a ring-shaped wedge element (6) extending around the tubular external wall (4), this wedge element (6) being arranged at the upper end of the cavity (7) and clamped between the tubular external wall (4) and an inner wall (10) of the cavity (7) in order to secure the pole (2) in the cavity (7) by wedging, wherein the wedge element (6) on its inner side is provided with supporting projections (14), through which the wedge element (6) bears against the tubular external wall (4), these supporting projections (14) are arranged at a distance from each other as seen in the circumferential direction of the wedge element, there are intermediate free spaces (15) between the supporting projections (14) as seen in the circumferential direction of the wedge element to allow parts of the tubular external wall (4) to be pressed into some of these free spaces (15) when the tubular external wall is subjected to buckling in connection with a collision against the pole, a reinforcement element (23) is mounted to a part of the section (8) of the tubular external wall (4) received in the cavity (7) to counteract buckling of this part, an upper end (24) of the reinforcement element (23) is arranged at a distance from said opening (9) of the cavity (7) as seen in the axial direction to allow, in connection with a collision against the pole (2), buckling of the part of the tubular external wall (4) located between the upper end (24) of the reinforcement element and the opening (9) of the cavity, longitudinal slits (30) are arranged in parallel with each other in the tubular external wall (4) and distributed in the circumferential direction thereof to facilitate buckling of the tubular external wall (4) in connection with a collision against the pole (2), and these slits (30) are arranged in an area of the tubular external wall (4) located above the foundation (5) and where a colliding motor vehicle is expected to hit the tubular external wall (4).

17. A pole arrangement comprising:

a hollow yielding pole (2) having a tubular external wall (4) of sheet metal;

a foundation (5) for anchoring the pole (2) to the ground, this foundation (5) having a vertical cavity (7) for receiving a lower section (8) of the tubular external wall (4) with the tubular external wall extending through an opening (9) at an upper end of the cavity (7); and a ring-shaped wedge element (6) extending around the tubular external wall (4), this wedge element (6) being arranged at the upper end of the cavity (7) and clamped between the tubular external wall (4) and an inner wall (10) of the cavity (7) in order to secure the pole (2) in the cavity (7) by wedging, wherein the wedge element (6) on its inner side is provided with supporting projections (14), through which the wedge element (6) bears against the tubular external wall (4), these supporting projections (14) are arranged at a distance from each other as seen in the circumferential direction of the wedge element, there are intermediate free spaces (15) between the supporting projections (14) as seen in the circumferential direction of the wedge element to allow parts of the tubular external wall (4) to be pressed into some of these free spaces (15) when the tubular external wall is subjected to buckling in connection with a collision against the pole, a reinforcement element (23) is mounted to a part of the section (8) of the tubular external wall (4) received in the cavity (7) to counteract buckling of this part, an upper end (24) of the reinforcement element (23) is arranged at a distance from said opening (9) of the cavity (7) as seen in the axial direction to allow, in connection with a collision against the pole (2), buckling of the part of the tubular external wall (4) located between the upper end (24) of the reinforcement element and the opening (9) of the cavity, the wedge element (6) has an outer circumferential envelope surface (18) bearing against the inner wall (10) of the cavity (7) along the entire outer circumferential envelope surface (18) from only concentrically within the inner wall (10) and on its inner side is provided with an inner annular surface having the supporting projections (14) which are radially-protruding and through which the wedge element (6) bears against the tubular external wall (4) at only said projections (14), and the intermediate free spaces (15) between the supporting projections (14) are defined by said supporting projections (14) and the inner annular surface as seen in the circumferential direction of the wedge element (6).

18. A pole arrangement according to claim 17, wherein the ring-shaped wedge element (6) is monolithic.

* * * * *